US005375266A

United States Patent [19]

Crisco

[11] Patent Number: 5,375,266

[45] Date of Patent: Dec. 27, 1994

[54] COMPOSITE DRAWCORD/ELASTIC WAISTBAND

[76] Inventor: J. Keith Crisco, 1263 Thayer Dr., Asheboro, N.C. 27203

[21] Appl. No.: 87,915

[22] Filed: Jul. 6, 1993

[51] Int. Cl.[5] ..... A41D 1/06

[52] U.S. Cl. ..... 2/243.1; 2/237; 2/76; 2/221

[58] Field of Search ..... 2/76, 236, 237, 220, 2/221, 243.1, 216, 217; 66/170, 172 E; 112/139, 413, 418, 262.1, 419

[56] References Cited

U.S. PATENT DOCUMENTS

| | | | |
|---|---|---|---|
| Re. 33,586 | 11/1991 | Graff . | |
| 735,560 | 10/1903 | Müller . | |
| 2,072,020 | 2/1937 | Barmon | 2/221 |
| 2,088,302 | 1/1937 | McKeever . | |
| 2,551,044 | 7/1951 | Ottinger et al. . | |
| 2,854,670 | 10/1958 | Naccash | 2/237 |
| 3,236,070 | 4/1966 | Clayton, Jr. . | |
| 3,887,968 | 3/1975 | Lynam . | |
| 4,466,137 | 6/1984 | Carnaghi . | |
| 4,477,928 | 10/1984 | Graff | 2/221 |
| 5,040,244 | 8/1991 | Tubbs | 2/237 |
| 5,168,581 | 9/1992 | Garcia et al. . | |

FOREIGN PATENT DOCUMENTS

| | | |
|---|---|---|
| 713891 | 8/1966 | Brazil . |
| 2295681 | 2/1976 | France . |
| 17330 | 7/1898 | Germany . |
| 1208680 | 9/1966 | Germany . |
| 720854 | 10/1966 | Spain . |
| 632522 | 1/1949 | United Kingdom . |
| 1392199 | 7/1975 | United Kingdom . |
| 1392200 | 12/1975 | United Kingdom . |
| 1456922 | 6/1976 | United Kingdom . |

*Primary Examiner*—Clifford D. Crowder
*Assistant Examiner*—Gloria Hale
*Attorney, Agent, or Firm*—Rhodes, Coats & Bennett

[57] ABSTRACT

A composite waistband includes an elastic band which is stretchable in the longitudinal direction and a non-elastic draw cord secured to one surface of the elastic band. The draw cord is secured to the elastic band by forming a plurality of stitches which extend over the draw cord and are sewn into the elastic band on either side of the draw cord. The plurality of stitches collectively define a longitudinally extending channel through which the draw cord extends.

8 Claims, 3 Drawing Sheets

COMPOSITE DRAWCORD/ELASTIC WAISTBAND

FIELD OF THE INVENTION

The present invention relates generally to elastic bands for use in the construction of garments. More particularly, the present invention relates to a combination elastic band and draw cord.

BACKGROUND OF THE INVENTION

Many types of clothing, such as athletic shorts and sweat pants, use an elastic waistband in combination with a drawstring so that the garment can be worn by persons of different size. In most garments of this type, the elastic waistband and drawstring are incorporated into the garment in separate steps. First, the waistband is stretched and sewn to the garment. The second step involves forming a channel for the drawstring and then inserting the drawstring into the channel. The drawstring is inserted into the channel by inserting a flexible wire with a hook into the channel and pulling the drawstring through the channel. This technique is labor intensive and significantly increases production cost.

Recently, it has been proposed to form the drawstring as an integral part of the waistband in order to eliminate one step in the construction of garments. For example, U.S. Pat. No. 4,477,928 discloses an elastic band in which the draw cord is intermeshed with the thread of the elastic band. One disadvantage of this process is that it requires the knitting or weaving machine used to manufacture the bands to be specially set up before production of the composite waistband. Setting up the knitting and weaving machines can be a time-consuming process during which the machine is out of production. Once the knitting or weaving machine is properly set up to produce the composite waistband, the manufacturer will ordinarily produce a relatively large inventory of composite waistbands before switching production back to conventional elastic bands. Another disadvantage of this technique is that it requires the replacement of one or more elastomeric strands in the fabric and with the draw cord. This alters the elastic properties of the fabric band which may be undesirable.

U.S. Pat. No. 5,040,244, discloses a composite waistband and drawstring in which the drawstring is releasibly secured to the surface of the waistband by an adhesive. However, the manufacturer of this type of composite waistband requires the use of special manufacturing equipment to heat and cure the adhesive.

SUMMARY AND OBJECTS OF THE INVENTION

The present invention is a composite waistband for use in manufacturing of garments. The composite waistband comprises an elongated web made of an elastic material which is stretchable in the longitudinal direction. The elastic band may be either woven or knitted. A non-elastic draw cord is secured to one surface of the band and extends in the longitudinal direction. The draw cord is secured to the surface of the elastic band by a stitching yarn which forms a plurality of longitudinally-spaced stitches. The draw cord may be non-elastic or elastic. The stitches are connected to the elastic band on either side of the draw cord and collectively define a longitudinally extending channel encompassing the draw cord. Since the stitching yarn does not penetrate the draw cord, the draw cord is free to slide within the channel formed by the stitching yarn.

The composite waistband of the present invention is made in a two-step process. First, the elastic band is knitted or woven in the usual manner using known techniques. The second step involves securing the draw cord to one surface of the elastic band. The two steps may be performed successively while on the knitting machine or may be performed separately by securing the draw cord to the fabric at a work station remote from the knitting or weaving machine. The elastic band is stretched in the longitudinal direction as the draw cord is laid along the length of the band. The draw cord is then secured to some appropriate-technique in which the draw cord is stitched to the surface of the band. The stitching yarn used to sew the draw cord bridges over the draw cord and is sewn into the elastic band on either side of the draw cord without penetrating the draw cord.

One advantage of the present invention is that the draw cord can be secured to the elastic band at any time after the manufacture of the elastic band. For example, the draw cord can be secured as part of a continuous process immediately following the knitting or weaving process in which the elastic band is formed. Alternately, the elastic band can be manufactured and stored for an extended length of time before the draw cord is secured to the band. Thus, the composite waistband of the present invention permits a greater degree of flexibility in planning inventory. Since the draw cord is secured by a separate operation, there is no need to halt the knitting or weaving process to specially set up for production. The attachment of the draw cord can be done, if desired, as an independent operation. Further, the resulting product is improved because the fabric band remains substantially flat on the side opposite the draw cord. This is more comfortable to the wearer. In addition, as previously mentioned, the elastic properties of the fabric and are unaltered and the band remains sturdier or firmer.

DETAILED DESCRIPTION OF THE INVENTION

Figure 1:
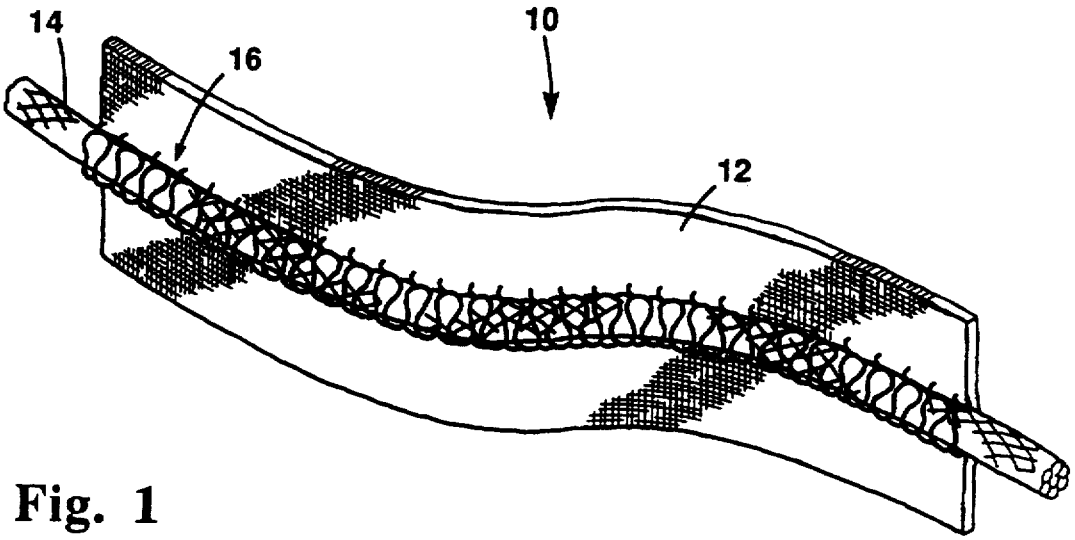
FIG. 1 shows a perspective view of the composite waistband of the present invention.
Figure 2:
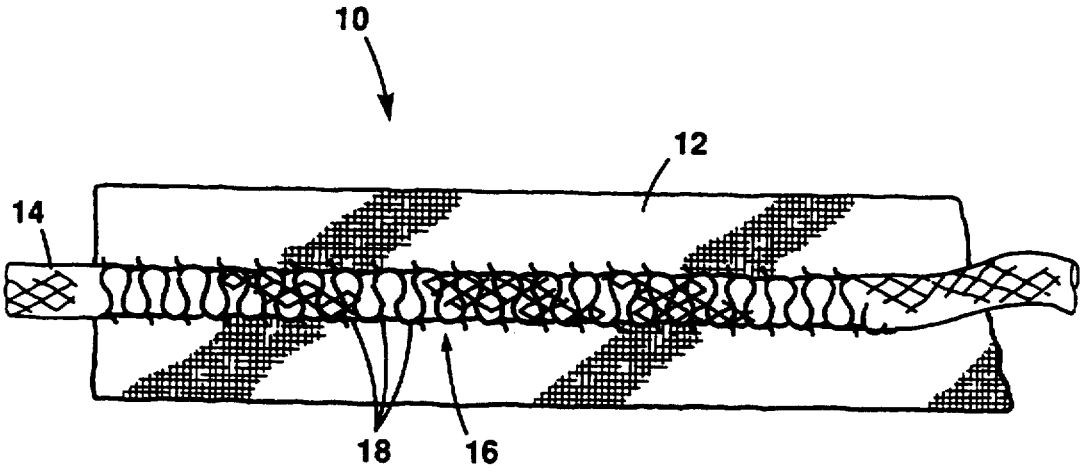
FIG. 2 is a top plan view of the composite waistband.

Referring now to the drawings, the composite waistband of the present invention is shown therein and indicated generally by the numeral 10. The composite waistband generally comprises an elongated band or web 12 made of an elastic material and a draw cord 14 made of elastic or non-elastic material. The draw cord 14 is disposed adjacent one surface of the elastic band 12 and extends in the longitudinal direction. The draw cord 14 is secured to the elastic band 12 using a yarn 16 to stitch the draw cord 14 to the surface of the elastic band 12.

The elastic band 12 is made from a natural or synthetic fiber and may have either a knitted or woven construction. For example, the elastic band may comprise a combination of polyester and elastomeric fibers. The elastomeric fibers extend in the longitudinal direction to allow lengthwise stretching. For most waistband applications, the elastic band 12 will have a width of one to two inches. The web 12 is stretchable from approximately 2 to 2½ times its relaxed length.

The draw cord 14 is preferably made from a synthetic material such as polyester and may be knitted, woven, or braided. The draw cord 14 is, in the described embodiment, substantially non-elastic. The draw cord 14 extends longitudinally along the surface of the elastic band 12. In the preferred construction, the draw cord 14 is disposed midway between the opposite edges of the band 12 and extends generally parallel to the edges.

Figure 3:
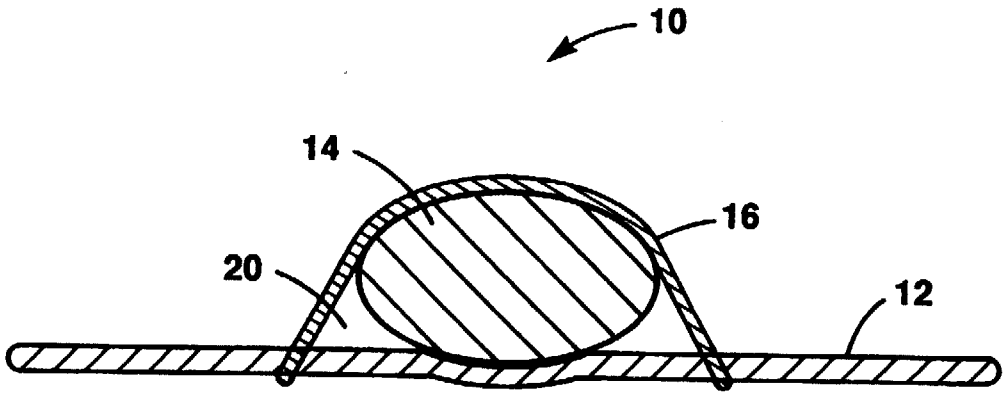
FIG. 3 is a cross-sectional view of the composite waistband taken along line 3—3 of FIG. 2.

A stitching yarn 16, made preferably of a synthetic fiber, slidably secures the draw cord 14 to the surface of the elastic band 12. The stitching yarn 16 forms a plurality of longitudinally-spaced stitches 18 which extend over the draw cord 14 as shown best in FIG. 3. The stitches 18 preferably extend continuously along the length of the band 12, but may also be discontinuous. The series of longitudinally-spaced stitches 18 define, in conjunction with the surface of the band 12, a longitudinally-extending channel 20. The yarn 16 is stitched into the elastic band on either side of the draw cord 14 by a suitable stitching cord 14 without penetrating the draw cord 14. Thus, the draw cord 14 may freely slide within the channel 20 defined by the longitudinally-spaced stitches 18.

To form the composite waistband 10 of the present invention, the elastic band 12 is first manufactured by conventional knitting or weaving methods. After the elastic band 12 is formed, the draw cord 14 is slidably secured to the elastic band 12. The stitching is effected by a plurality of longitudinally-spaced stitches 18 which intermesh with the elastic band 12 on either side of the draw cord 14. After the stitching operation is completed, the elastic band 12 is allowed to return to its normal relaxed state. When the elastic band 12 relaxes, the draw cord 14 will contract or relax in the longitudinal direction. Thus, the draw cord 14 will have a greater length when the fabric band is stretched than the elastic band is in its relaxed state.

The sewing step can be performed immediately following the manufacture of the elastic band 12 in one continuous operation. Alternately, the elastic band 12 can be manufactured and stored for an extended length of time before the draw cord 14 is secured to the band 12. One significant advantage of this approach is that large inventories of the composite waistband 10 do not have to be maintained. When orders are placed for the composite waistband 10, the draw cord 14 can be secured to conventional elastic bands 12 in inventory. There is no need to maintain a separate inventory of composite waistbands 10.

Figure 4:
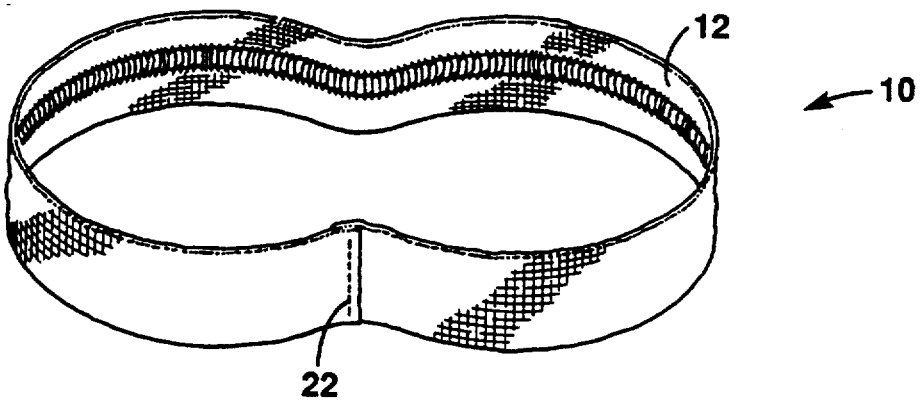
FIG. 4 is a perspective view of the composite waistband formed into a continuous loop.

To use the composite waistband 10 of the present invention, the composite waistband 10 is cut to the desired length and the ends are stitched together to form a continuous loop as shown in FIG. 4. The opposite ends of the composite waistband 10 are disposed in overlapping relationship and then stitched together using an overedge stitch 22. The continuous loop is then incorporated into a garment 24, such as the one shown in FIG. 5.

Figure 5:
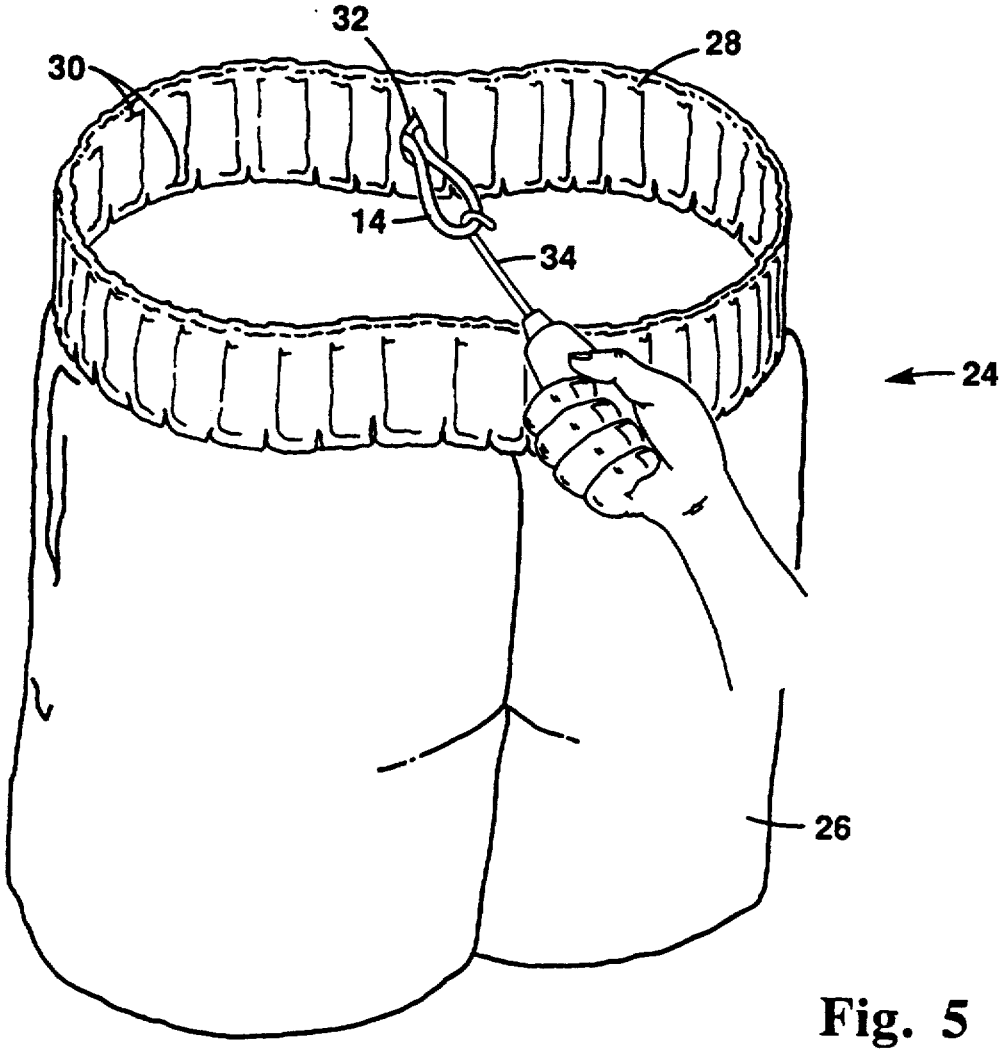
FIG. 5 is a perspective view of a garment incorporating the composite waistband.

The garment 24 shown in FIG. 5 comprises a pair of shorts including a body covering portion 26 and a waistband portion 28 which is adapted to surround the waist of the wearer. The waistband portion 28 is formed by folding over enough of the garment material to encompass the composite waistband 10 between two layers of the material. Two or more parallel rows of stitches 30 secure the folded-over garment material together with the enclosed composite waistband 10. This stitching operation is done while the composite waistband 10 is stretched.

Because the draw cord 14 is incorporated into the composite waistband 10, the draw cord 14 does not have to be inserted in a separate manufacturing step. Accordingly, the composite waistband 10 of the present invention greatly simplifies the manufacturing of garments.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An elastic band comprising:

(a) an elongated band of elastic material which is stretchable in the longitudinal direction;

(b) a non-elastic draw cord disposed adjacent to one surface of the elastic band; and (c) a stitching yarn forming a plurality of longitudinally-spaced stitches extending over the non-elastic draw cord and stitched into the elastic band on either side of the draw cord for slidably securing the draw cord to the elastic band, wherein said stitches collectively define a longitudinally-extending channel through which the draw cord extends.

2. The composite waistband of claim 1 wherein the longitudinally spaced stitches extends continuously along the length of the elastic band.

3. The composite waistband of claim 1 wherein the elastic band has a knitted construction.

4. The composite waistband of claim 1 wherein the elastic band is woven.

5. A composite waistband comprising:

(a) a narrow, longitudinally extending web made of a textile material;

(b) a draw cord secured to one surface of the web by a plurality of stitches sewn into the web and extending over the draw cord to define a longitudinally extending channel for the draw cord.

6. The composite waistband of claim 5 wherein the longitudinally spaced stitches extends continuously along the length of the elastic band.

7. The composite waistband of claim 5 wherein the elastic band has a knitted construction.

8. The composite waistband of claim 5 wherein the elastic band is woven.

* * * * *

UNITED STATES PATENT AND TRADEMARK OFFICE

CERTIFICATE OF CORRECTION

PATENT NO. : 5,375,266

DATED : December 27, 1994

INVENTOR(S) : J. Keith Crisco

It is certified that error appears in the above—identified patent and that said Letters Patent is hereby corrected as shown below:

In The Claims:

Column 4, line 52, insert —non-elastic—, before "draw"

Signed and Sealed this

Sixteenth Day of May, 1995

*Attest:*

Bruce Lehman

BRUCE LEHMAN

*Attesting Officer*

*Commissioner of Patents and Trademarks*